US008002588B1

(12) United States Patent
Zhu et al.

(10) Patent No.: US 8,002,588 B1
(45) Date of Patent: Aug. 23, 2011

(54) ELECTRICAL CONNECTOR TO DECREASE MOLDING FLASHES

(75) Inventors: Yu Zhu, Shenzhen (CN); Wei Yuan, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/911,748

(22) Filed: Oct. 26, 2010

(30) Foreign Application Priority Data

Mar. 18, 2010 (CN) ..... 2010 2 0133853

(51) Int. Cl.
*H01R 24/00* (2011.01)

(52) U.S. Cl. ..... 439/660

(58) Field of Classification Search ..... 439/660, 439/638–639, 630, 74, 78, 862, 83, 357
See application file for complete search history.

(56) References Cited

U.S. PATENT DOCUMENTS

| | | | | |
|---|---|---|---|---|
| 6,971,915 | B1 * | 12/2005 | Mao et al. | 439/607.37 |
| 7,588,443 | B2 * | 9/2009 | Wu et al. | 439/74 |
| 7,651,375 | B2 * | 1/2010 | Zhu et al. | 439/607.41 |
| 7,833,065 | B2 * | 11/2010 | Lin et al. | 439/639 |
| 7,909,652 | B2 * | 3/2011 | Yang et al. | 439/660 |
| 2010/0055986 | A1 * | 3/2010 | Wang et al. | 439/638 |
| 2010/0120292 | A1 * | 5/2010 | Lee et al. | 439/660 |
| 2010/0158449 | A1 * | 6/2010 | Yi | 385/75 |
| 2010/0190383 | A1 * | 7/2010 | Yamada et al. | 439/680 |

* cited by examiner

*Primary Examiner* — Jean F Duverne
(74) *Attorney, Agent, or Firm* — Wei Te Chung; Andrew C. Cheng; Ming Chieh Chang

(57) ABSTRACT

An electrical connector includes an insulative housing defining a mating port with a mating tongue exposing therein and a base from which the mating tongue extends forwardly. A plurality of grooves is arranged in the mating tongue and extends along a front-to-back direction through the base. A plurality of contacts defines mating sections received in the grooves. Each of the grooves defines a wider portion adjacent to the base.

3 Claims, 6 Drawing Sheets

ELECTRICAL CONNECTOR TO DECREASE MOLDING FLASHES

BACKGROUND OF THE INVENTION

1. Field of the Invention

The present invention generally relates to an electrical connector, and more particularly, to a novel structure of an electrical connector to decrease molding flashes.

2. Description of Related Art

An conventional electrical connector includes an insulative housing formed by injection molding and defining a plurality of passageways for retaining a plurality of contacts. We find that there is a step in each passageway. The step is caused by a molding die after cooling of the housing. Because the molding die suffered a lot of wear and tear after working for a long time. During the contacts are inserted into the passageways, the contacts might collide to cause molding flashes. The molding flashes will stop the contacts from further being inserted into the passageways, which will influence an electrical connection of the electrical connector. Thus, an electrical connector to decrease the molding flashes is desired to overcome the disadvantages of the related art.

Hence, the present invention is directed to solving this problem in the related art.

SUMMARY OF THE INVENTION

An object of the invention is to provide an electrical connector to decrease molding flashes.

In order to achieve the object set forth, an electrical connector includes an insulative housing defining a mating port with a mating tongue exposing therein and a base from which the mating tongue extending forwardly. A plurality of grooves is arranged in the mating tongue and extends along a front-to-back direction through the base. A plurality of contacts defines mating sections received in the grooves. Each of the grooves defines a wider portion adjacent to the base.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
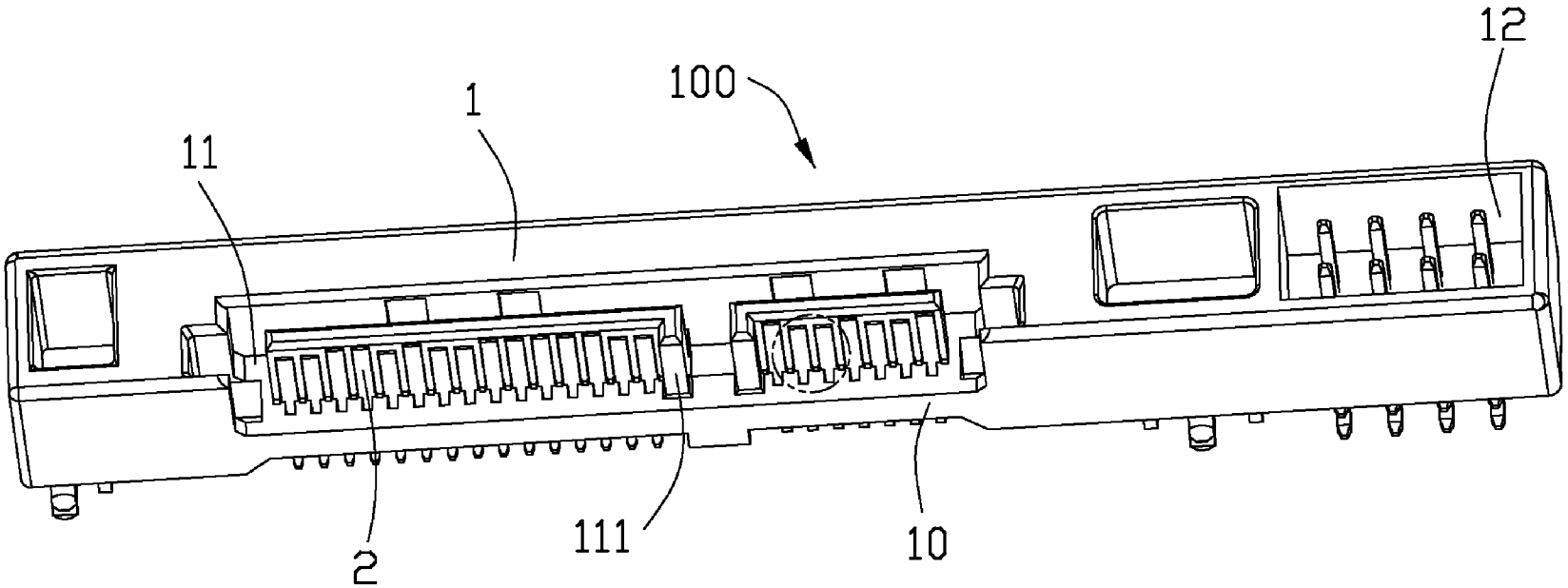
FIG. 1 is a perspective view of an electrical connector of an embodiment of the present invention.
Figure 2:
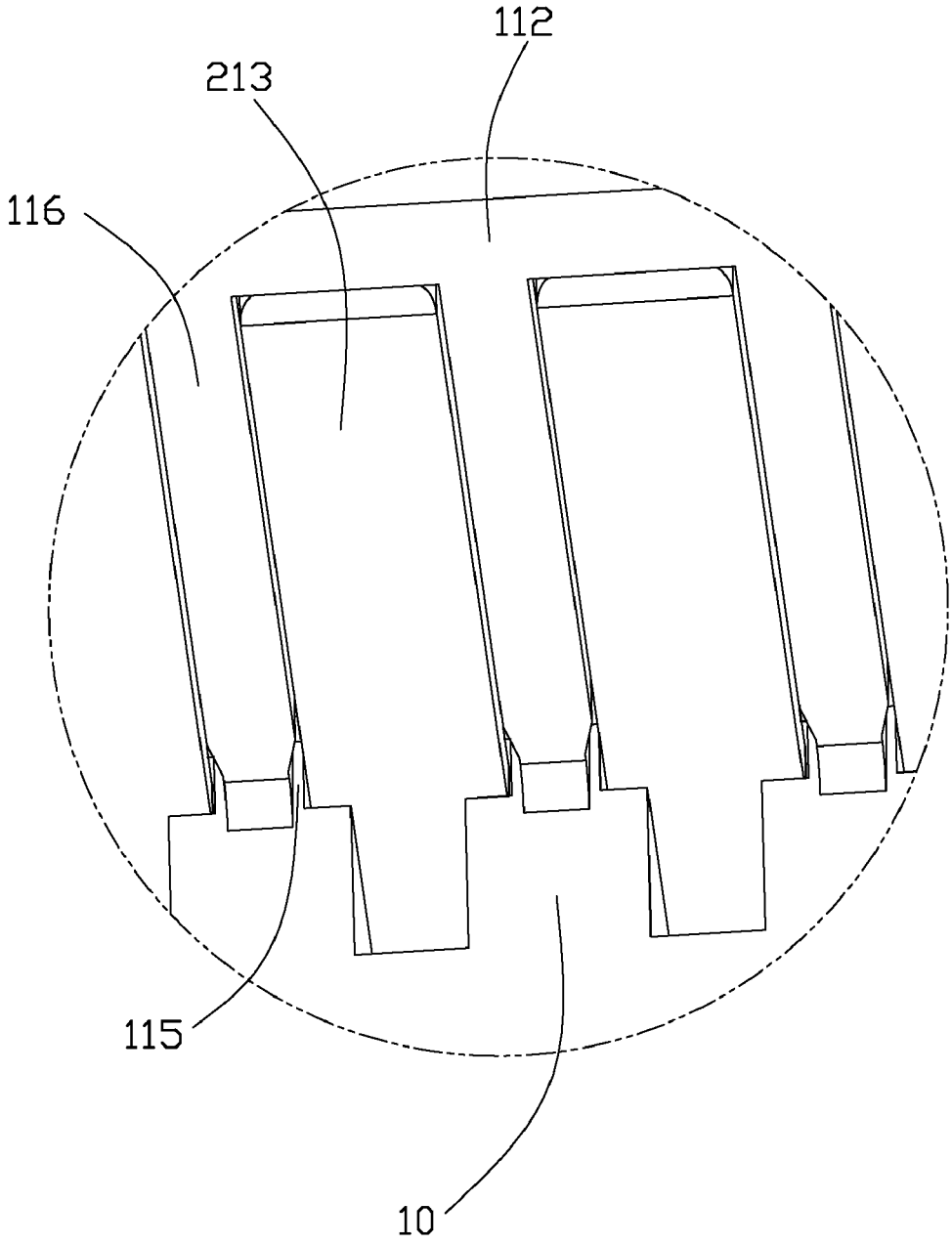
FIG. 2 is a partly-enlarged view of the electrical connector as shown in FIG. 1.

Referring to FIG. 1, an electrical connector 100 of the present invention is accordance with a Serial Advanced Technology Attachment (SATA) standard. The electrical connector 100 comprises an insulative housing 1 defining two mating ports 11, 12 side by side with a plurality of contact 2 disposed in the mating ports 11, 12.

Referring to FIGS. 1 to 6, the insulative housing 1 defines a first mating port 11 with an L-shaped mating tongue 111 exposing thereto and a base 10 from which the mating tongue 111 extends forwardly. A plurality of grooves 113 extends along a front-to-back direction and is arranged along a transverse direction perpendicular to the front-to-back direction, in and under a mating face 112 of the mating tongue 111 for receiving a plurality of first contacts 21. Each groove 113 extends through the base 10 to form a retaining slot 114 in the base 10 for retaining the first contact 21. A plurality of separators 116 is formed in the mating face 112. Each separator 116 partitions every two neighboring grooves 113 by two sides thereof. Each groove 113 has a wider portion 115 adjacent to the base 10 along the transverse direction than a front end of each first contact 21 in said direction, which construe with a pair of slots extending outwardly to two sides of the groove 113. The wider portions 115 of the grooves 113 are symmetrical about corresponding central axis of the grooves. Each wider portion 115 extends in and under the mating face 112 of the mating tongue 111 and extends backwardly until the base 10. In other word, a pair of slots is formed at two sides of each separator 116 adjacent to the base 10 (refer to FIG. 2). A narrow portion 117 of the separator is formed between the pair of slots at the back end of the separator 116. A distance between the adjacent narrow portions 117 is wider than a distance between the reminder portions of the separator 116 (refer to FIG. 6). A step in the groove 113 is caused by the molding die suffered a lot of wear and tear after molding. When the first contacts 21 pass through the grooves, they hurt the steps to cause molding flashes. Thus, the molding flashes can be received in the pair of slots at two sides of the groove 113. The first contacts 21 can be easy to be assembled in the grooves 113.

Figure 3:
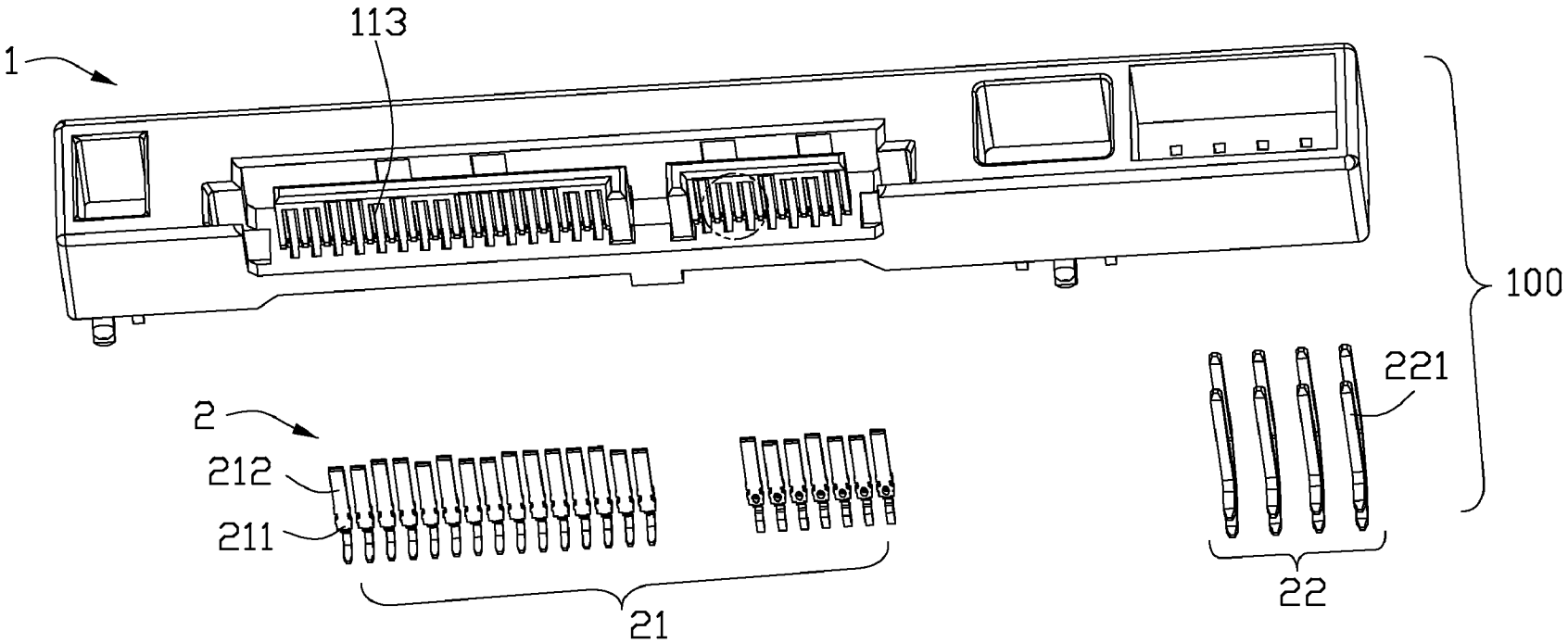
FIG. 3 is an exploded perspective view of the electrical connector as shown in FIG. 1.
Figure 4:
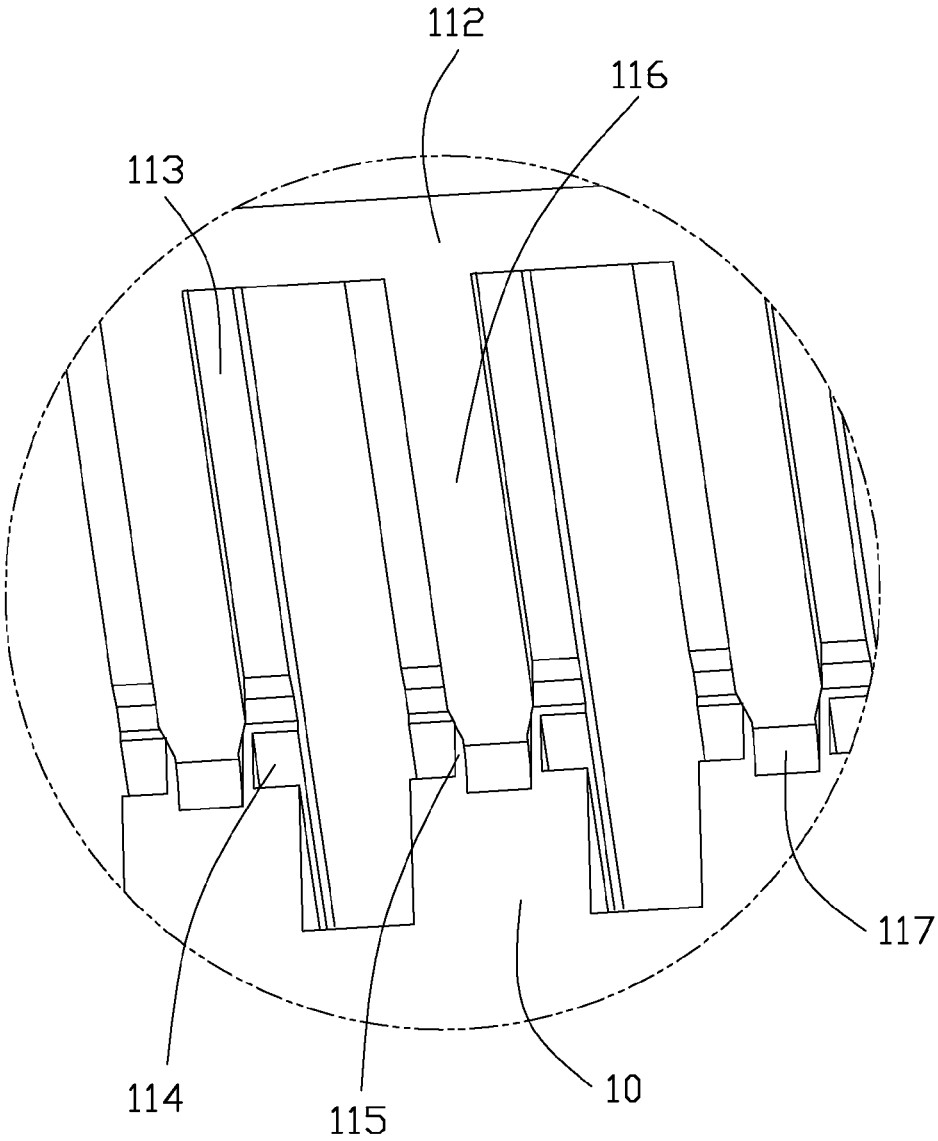
FIG. 4 is a partly-enlarged view of the insulative housing of the electrical connector as shown in FIG. 3.
Figure 5:
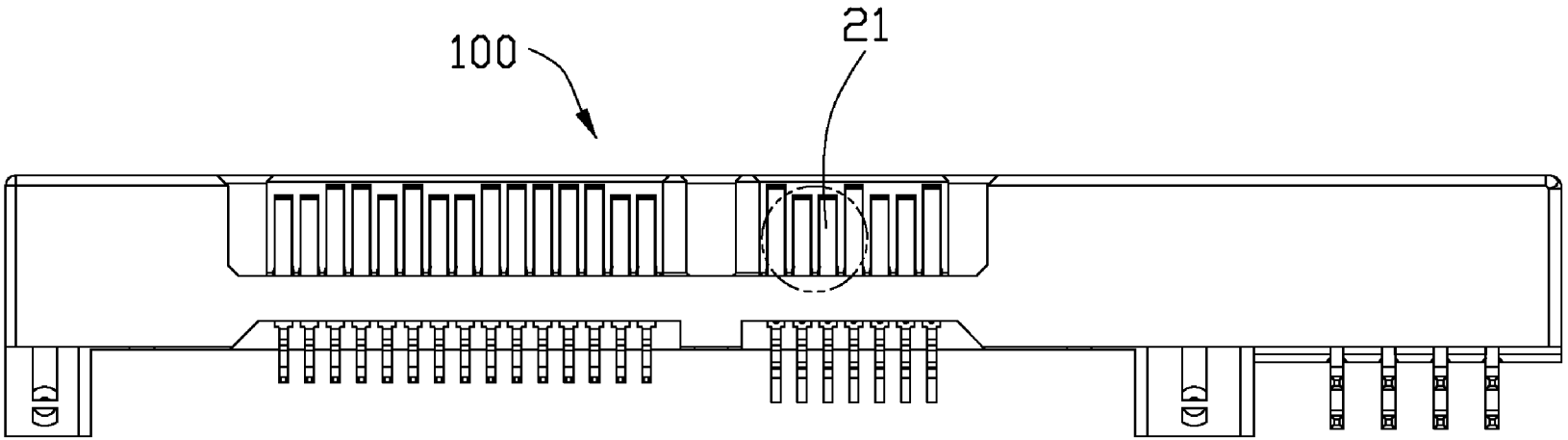
FIG. 5 is a front view of the electrical connector as shown in FIG. 1.
Figure 6:
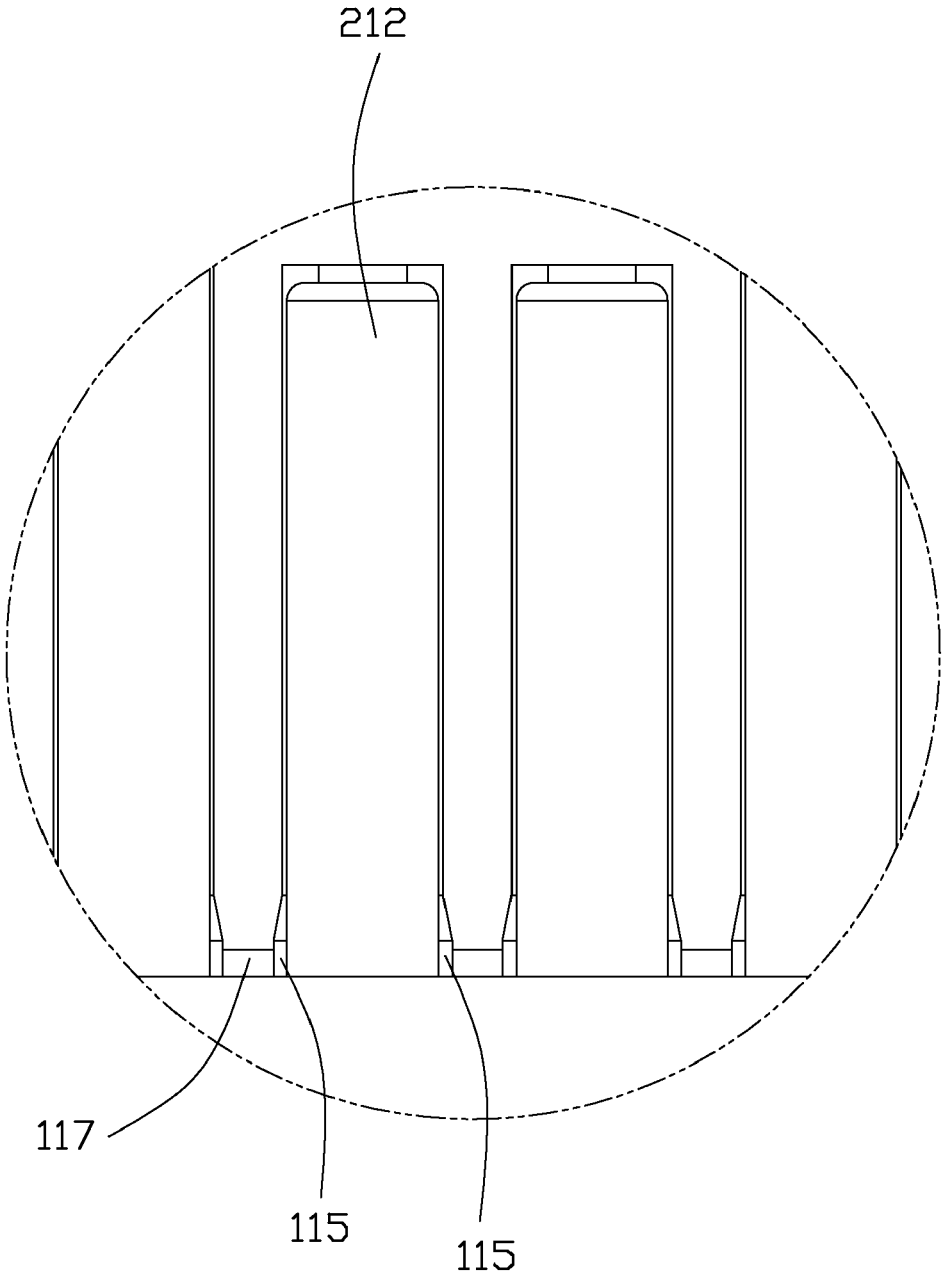
FIG. 6 is a partly-enlarged view of the electrical connector as shown in FIG. 1.

Referring to FIG. 3, the contacts 2 includes a plurality of the first contacts 21 disposed in the mating tongue 111 of the first mating port 11. Each first contact 21 defines a mating section 212 received in the corresponding groove 113. The mating section 212 defines a planar outer face 213 away from the mating face 112 of the mating tongue 111 and slightly above the mating face 112 in a vertical direction perpendicular to said front-to-back direction for engagement with a complementary contact of a counterpart connector (not shown). A retention portion 211 extends backwardly from the mating section 212 in the retaining slot 114. The retention sections 211 are narrower to the mating section 212 in a back end of the mating sections so that retaining slots 114 in the housing is narrower than the grooves 113. The first contacts are inserted in the mating tongue 111 along a back-to-front direction and from the retaining slots 114 of the base 10 to the grooves 113 of the mating tongue 111. The mating sections 212 of the first contacts 21 have a same width therealong, thereby the mating sections 212 space away from inside surfaces of the grooves 113 at the wider portion 115 (refer to FIG. 6). The molding flashes being caused by the first contacts hurting the steps of the grooves 113 can be received in the slot 115 between the narrow portion 117 and the mating section 212. Especially, the steps are often formed at a joint between the mating tongue and the base during the molding process, so that the front ends of the first contacts 21 might collide to the step at the joint. The wider portions of the grooves adjacent to the base particularly benefit beginning insertion of the front ends of the first contact to the grooves.

Referring to FIG. 1 and FIG. 3, the insulative housing also includes a second mating port 12 and a plurality of second contacts 22 disposed in the second mating port 12. Each second contact 22 defines a needle-shaped contact portion 221 different from the mating section 212 of the first contact 21 for inserting into a complementary contact (not shown). The first mating port 11 is for transmitting signals and the second mating port 12 is for testing the complementary connector. The novel electrical connector 110 with a pair of slots 115 at two sides of the groove 113 is benefit to the first contacts 21 assembled in the mating tongue 111. Thus, it can improve the electrical connection of the electrical connector.

What is claimed is:

1. An electrical connector comprising:

an insulative housing defining a mating port with a mating tongue exposing therein and a base from which the mating tongue extends forwardly, a plurality of grooves arranged in the mating tongue and extending along a front-to-back direction through the base; and a plurality of contacts including mating sections received in the grooves;

wherein each of the grooves defines a wider portion adjacent to the base; wherein the mating sections of the contacts have a same width therealong, thereby the mating sections space away from inside surfaces of the grooves at the wider portions; wherein the wider portions of the grooves are symmetrical about corresponding central axis of the grooves; wherein the base defines retaining slots aligned with corresponding grooves to receive and retain the contacts; wherein the mating section of the contact defines a planar outer face away from a mating face of the mating tongue and slightly above the mating face in a vertical direction perpendicular to said front-to-back direction for engagement with a complementary contact of a counterpart connector; wherein said insulative housing defines a second mating port with said mating port side by side, a plurality of second contacts disposed in the second mating port and different from said contacts disposed in the mating tongue.

2. The electrical connector as claimed in claim 1, wherein said mating tongue is L-shaped.

3. An electrical connector comprising:

an insulative housing defining a base with a mating tongue extending forwardly therefrom;

a plurality of contact receiving grooves disposed in the housing and extending forwardly along a mating direction from the base into the mating tongue; and a plurality of contacts forwardly inserted into and disposed in the corresponding grooves, each of said contacts including a flat mating section disposed upon the mating tongue in a snug manner within the corresponding groove transversely; wherein each of said grooves is transversely widened at a root of said mating tongue for accommodating scraps occurring at said root due to forwardly insertion of the contact into the corresponding groove; wherein a plurality of separators are formed on the mating tongue and alternately arranged with the grooves in a transverse direction perpendicular to said mating direction, and each of said separators defines an increased cross-section at the root of the mating tongue for reinforcement; wherein said increased cross-section defines a curved tapered configuration.

* * * * *